United States Patent [19]

Beaven, Jr. et al.

[11] 4,040,511

[45] Aug. 9, 1977

[54] PAPER MOVING MECHANISM

[75] Inventors: Herbert R. Beaven, Jr., Los Altos; Daniel M. Roberts, Saratoga, both of Calif.

[73] Assignee: Rockwell International Corporation, El Segundo, Calif.

[21] Appl. No.: 610,905

[22] Filed: Sept. 5, 1975

[51] Int. Cl.[2] ..... B41J 15/00

[52] U.S. Cl. ..... 197/133 R; 226/134; 226/154; 226/156; 226/162

[58] Field of Search ..... 197/133 R, 133 F, 133 T; 101/3 R, 27, 32, 287, 288, 291, 292, 297, 316, 196–198; 226/134, 152, 154, 156, 162–165; 221/61, 62, 66, 70, 69, 197, 287

[56] References Cited

U.S. PATENT DOCUMENTS

| | | | |
|---|---|---|---|
| 2,540,297 | 2/1951 | Freeman et al. | 197/133 R X |
| 2,610,723 | 9/1952 | Fleischmann et al. | 197/133 F |
| 2,919,643 | 1/1960 | Von Hollen | 101/288 |
| 3,294,212 | 12/1966 | Gearheart et al. | 197/133 R |
| 3,306,491 | 2/1967 | Eisner et al. | 221/197 X |
| 3,310,199 | 3/1967 | Roberts et al. | 221/197 X |
| 3,429,258 | 2/1969 | Baranoff et al. | 101/288 X |
| 3,511,426 | 5/1970 | Whitmore et al. | 226/156 X |
| 3,837,461 | 9/1974 | Waibel | 101/287 X |
| 3,921,879 | 11/1975 | Peters | 226/156 X |

*Primary Examiner*—E. H. Eickholt
*Attorney, Agent, or Firm*—H. Fredrick Hamann; G. Donald Weber, Jr.

[57] ABSTRACT

A paper feeding mechanism for selectively advancing paper a predetermined distance past a printing station of an electronic business machine. The paper feeding mechanism is adapted to utilize a supply of fan folded paper, e.g., housed in a disposable cartridge, which may be readily inserted within the paper feeding mechanism to place the electronic business machine in readiness for operation. During the printing cycle, a contact mechanism maintains a portion of the paper in contact with the printing station of the electronic business machine. After the printing occurs, an actuation mechanism is energized to move the contact mechanism away from the printing station to free the paper for advancement. At the same time, the actuation mechanism moves an advancement mechanism to advance the paper a predetermined distance past the printing station of the electronic business machine.

11 Claims, 7 Drawing Figures

17A
C
14
A
13
15
B
17
75
12
16
17A
10
11

50a
50
50b
52a
52b
51
42
47
48
49

13
25a
52b
15
39
52a
47
49
17
48
75
11d
39
50b
14
50
17A

PAPER MOVING MECHANISM

BACKGROUND OF THE INVENTION

1. Field of the Invention

This invention relates to electronic business machines that provide a printed readout, and more particularly to a low silhouette paper feeding mechanism for advancing paper past the printing station of an electronic business machine.

2. Description of the Prior Art

With the advent of the MOS/LSI circuit technique, many types of electronic business machines have become widely available to the public. For example, electronic calculators have been priced within the reach of practically everyone. For the most part, such electronic calculators employ a visual display, such as, a liquid crystal display or a light-emitting diode display. However, these displays are generally volatile and provide only one line of information at a time. On the other hand, it is highly desirable for many purposes to have a printed readout of the entire series of calculations performed. The hard copy printed readout would allow the operator to check the inputs that were placed into the calculator and would also allow copies to be made of the calculations performed or to retain copies of records for business purposes.

Some of the larger and more expensive electronic business machines do provide a printed readout in addition to the volatile display. Some of these machines employ standard printing drum techniques to produce a printed readout, while others employ thermal printing techniques to provide a printed readout. Thermal printing techniques involve non-impact printing wherein specially treated paper is placed in contact with a thermal printing station having an array of heating elements, such as, nichrome resistors, which are selectively energized and heated so as to print a line of characters on the specially treated paper.

However, most of the existing mechanisms for advancing paper past the printing station are quite complex and expensive. Such existing mechanisms also require a number of time consuming manipulations to insert the paper within the paper feeding mechanism before the electronic business machine is ready for operation. In addition, such mechanisms generally advance paper from a roll of paper. In view of the latest packaging techniques, wherein electronic business machines have become quite compact, a roll of paper is relatively large and bulky in comparison.

SUMMARY OF THE INVENTION

The present invention provides a paper feeding mechanism for selectively advancing paper a predetermined distance past a printing station of an electronic business machine. The paper feeding mechanism is adapted to store a supply of fan folded paper that may be readily inserted, e.g., as a cartridge, within the paper feeding mechanism to place the electronic business machine in readiness for operation. During the printing cycle, a contact mechanism maintains a portion of the paper in contact with the printing station of the electronic business machine. After the printing occurs, an actuation mechanism is energized to move the contact mechanism away from the printing station so as to free the paper for advancement. At the same time, the actuation mechanism moves an advancement for advancing the paper past the printing station of the electronic business machine. After the advancement of the paper, the contact mechanism places the next portion of the paper in contact with the printing station.

The paper feeding mechanism includes an access panel that may be opened to insert a new supply (or cartridge) of fan folded paper. The inner side of the access panel is the support base for the supply of fan folded paper. In addition, that part of the contact mechanism that places the free end of the paper in contact with the printing station is mounted on the inner side of the access panel. The supply of fan folded paper or cartridges may be snapped into place on the inner side of the access panel; the free end of the paper or paper leader is placed against the print station. The access panel is then closed and the electronic business machine is ready for operation. Thus, there is no need for any time consuming threading of the paper in the advancement mechanism, or between the contact mechanism and the printing station.

DESCRIPTION OF THE PREFERRED EMBODIMENTS

Figures 1, 6, 7:
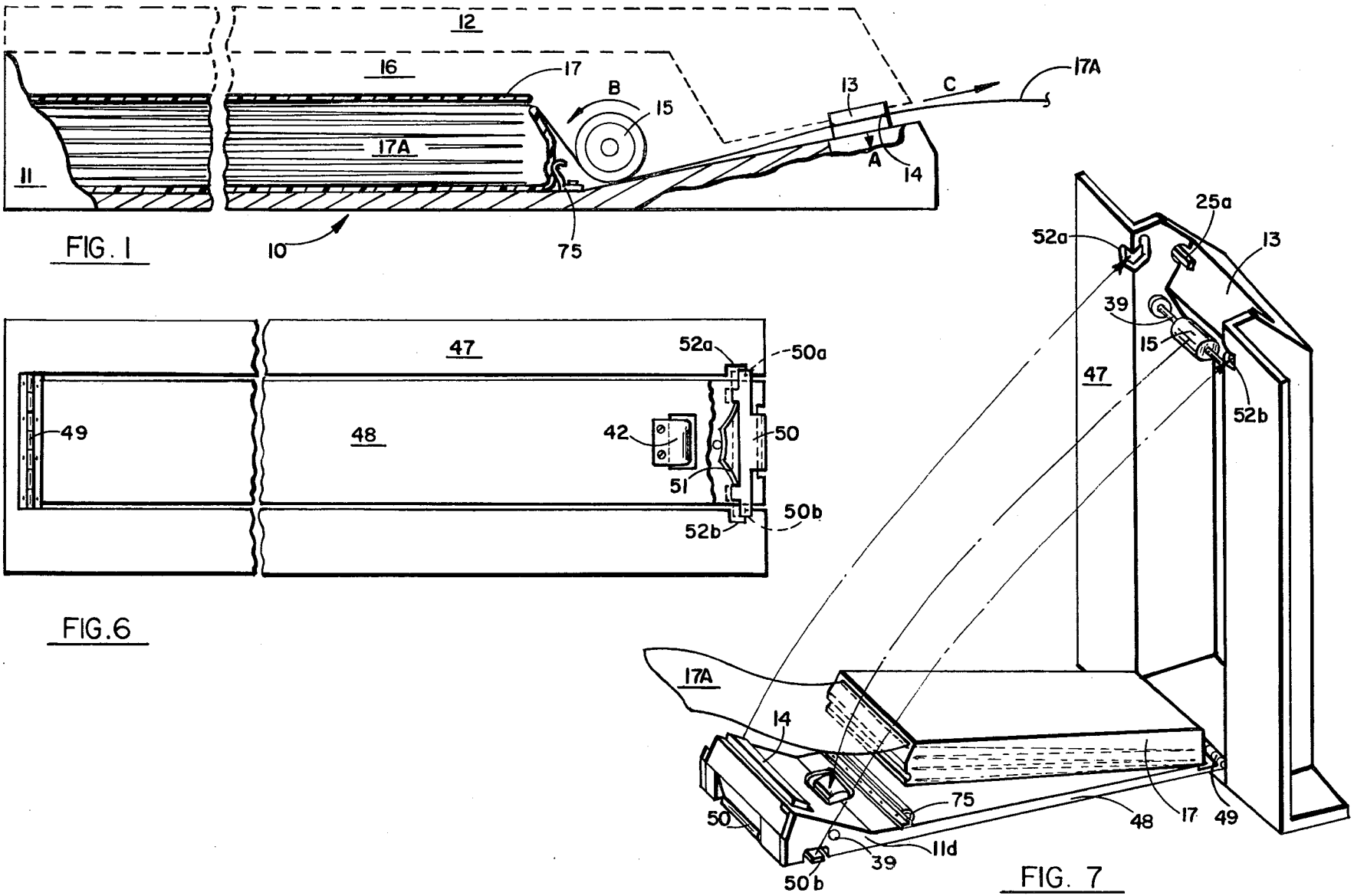
FIG. 1 is a simplified cross sectional diagram of an electronic business machine, illustrating the movement of paper therein, in accordance with the present invention.
FIG. 6 is a bottom plan view of the paper feeding mechanism, with portions cut away to expose the various components located therein.
FIG. 7 is a perspective view of the paper feeding mechanism, with the access panel of the paper feeding mechanism shown in the open position.

Referring now to FIG. 1, there is shown a simplified diagram of a portion of an electronic business machine 10, illustrating the movement of paper therein, in accordance with the present invention. The electronic business machine 10 is generally comprised of a paper feeding apparatus 11 and an area 12 that is generally defined by the dashed lines. The area 12 represents various types of electronic apparatus for processing information, for example, a portable or hand-held calculator. Such a calculator normally includes a keyboard, a display, and associated electronic circuitry for processing information that is to be displayed. In addition, area 12 also represents additional electronic circuitry for transferring processed information to a printing station 13, so that such information may also be printed on a permanent medium. Printing station 13 may be of any suitable type such as an impact or a thermal printer. In the preferred embodiment, printing station 13 is described as employing thermal printing techniques wherein a plurality of heating elements are selectively energized in response to such processed information, to produce characters that are transferred to suitable paper in any known manner by printing station 13.

The paper feeding apparatus 11 of FIG. 1 is generally comprised of a pressure pad 14, a roller 15, and a paper storage area 16 for storing a supply of fan folded paper 17A in a cartridge-like compartment 17. It is noted that not all parts of the paper feeding apparatus 11 of the present invention are shown in FIG. 1; however, such parts are shown in remaining FIGS. 2–7 and will be fully discussed later in the specification. In the embodiment described herein, pressure pad 14 is normally biased to maintain a portion of the paper 17A in contact with the printing station 13, as shown, so as to allow characters to be printed on such portion. The roller 15 is normally stationary and is in contact with the paper 17A as shown.

During a typical printing cycle, characters are printed on the portion of paper in contact with the printing station 13 in response to signals from area 12. Thereafter, so as to avoid overheating or sticking of paper 17A, an appropriate signal from the electronic apparatus of area 12 energizes actuation means (not presently shown) of the paper feeding apparatus 11 to move the pressure pad 14 and the roller 15. The pressure pad 14 is moved away from the printing station 13, in the direction of the arrow designated A, so as to free paper 17A for advancement, and the roller 15 is rotated in the couter-clockwise direction, as shown by the arrow designated B, to advance the paper in a direction of the arrow designated C. Thus, the portion of paper 17A having printing thereon is advanced out of the electronic business machine 10 and the pressure pad 14 returns to its normal postion to place the next portion of the paper 17 in contact with the printing station 13.

Figure 2:
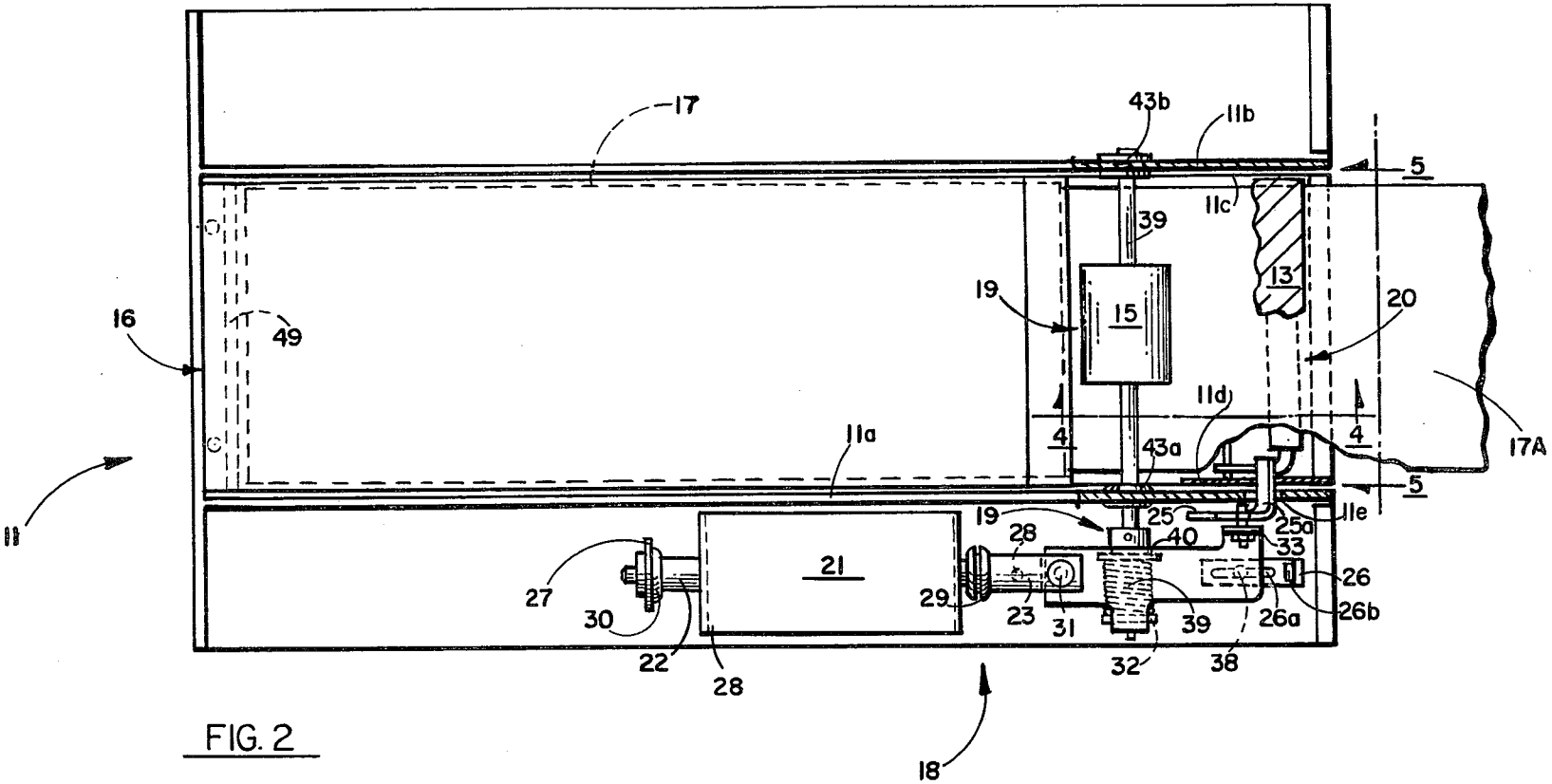
FIG. 2 is a top plan view of one embodiment of a paper feeding mechanism, with portions cut away to expose various components located therein, in accordance with the present invention.
Figure 3:
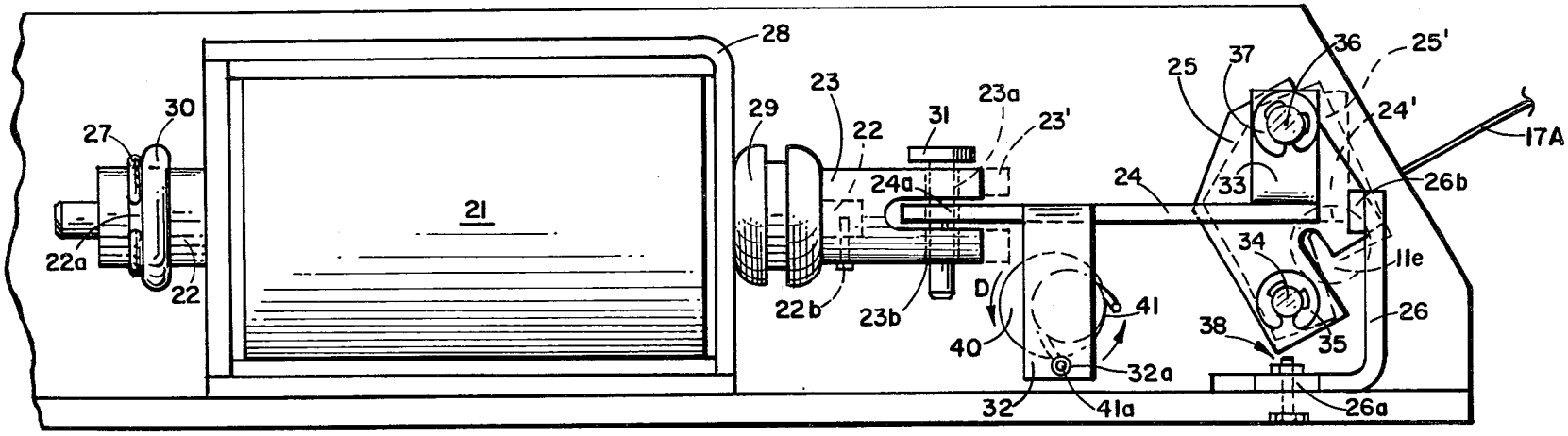
FIG. 3 is a side elevational view of the paper feeding mechanism in accordance with the present invention.

Referring now to FIGS. 2 and 3, there are shown respective top plan and side elevational views of the paper feeding apparatus 11, with portions cut away to expose various components located therein. The paper feeding apparatus 11 is generally comprised of an actuation mechanism 18, an advancement mechanism 19, and a contact mechanism 20. Upon energization thereof, the actuation mechanism 18 moves the contact mechanism 20 to free the paper 17A and moves the advancement mechanism 19 to advance the paper 17A a predetermined distance.

The actuation mechanism 18 is primarily comprised of solenoid 21 having a plunger 22, a yoke-shaped coupling member 23, an elongated linkage member 24, a vertically disposed linkage member 25, and a feed control member 26. The solenoid 21 is mounted in a bracket 28 which has suitable openings for the plunger 22. One end of the plunger 22 is secured by an E-ring 27 that is located within a suitable groove **22*a* of the plunger 22, and the other end of the plunger 22 is coupled to the yoke-shaped coupling member 23 by means of a screw 22*b*. A pair of rubber grommets 29 and 30 are located on opposite ends of the plunger 22 as shown, to absorb any shock created by the movement of the plunger 22. A pin 31 is located within a pair of openings 23*a* and 23*b* of the yoke-shaped coupling member 23 and an opening 24*a* of the elongated linkage member 24 to couple the yoke-shaped coupling member 23 to the elongated linkage member 24, as shown in FIG. 3**.

The elongated linkage member 24 includes a first extension member 32 and a second extension member 33 for respectively linking the elongated linkage member 24 to the advancement mechanism 19 and the vertically disposed linkage member 25. The vertically disposed linkage member 25 is rotatably mounted to the sidewall **11*a* by means of a pin 34 that has one end fixedly mounted to the sidewall 11*a* and the other end extends through a suitable opening of the vertically disposed linkage member 25 and is retained therein by means of E-ring 35. Another pin 36 has one end fixedly mounted to the upper end of the vertically disposed linkage member 25 and the other end is located with a suitable opening of the second extension member 33 and is retained therein by means of an E-ring 37. An extended tab member 25*a* of the vertically disposed linkage member 25 is extended through an opening 11*e* of the sidewall 11*a* so that it may selectively engage the contact mechanism 20**.

The distance traveled by the elongated linkage member 24 ultimately determines the distance that the paper 17A is advanced. The distance traveled by the elongated linkage member 24 is controlled by the positioning of the feed control member 26. A slot **26*a* allows the feed control member 26 to be repositioned so as to adjust the distance that the paper 17A is advanced. A nut and bolt combination 38 is utilized to mount the feed control member 26 as shown. The feed control member 26 may include a resilient pad 26*b* to cushion the contact of the elongated linkage member 24**.

Figure 4:
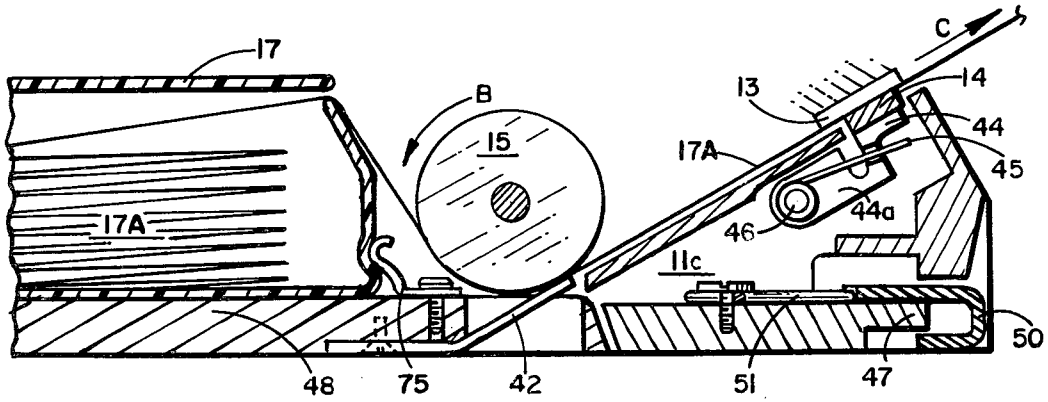
FIG. 4 is a side elevational view of the paper feeding mechanism taken along the lines 4—4 of FIG. 2.

The advancing mechanism 19 is primarily comprised of the roller 15, a shaft 39, a cylindrical sleeve 40, and a wrap spring 41. The roller 15 may be of any suitable material to provide sufficient contact with the paper 17A to advance the paper upon rotation of the shaft 39. A leaf spring 42 may be employed as shown in FIG. 4 to ensure contact of the roller 15 with the paper 17. The shaft 39 is mounted within suitable openings of the sidewalls **11*a* and 11*b* by means of a pair of bearings 43*a* and 43*b*. The roller 15 and the cylindrical sleeve 40 are fixedly mounted on the shaft 39. The wrap spring 41 is mounted on the cylindrical sleeve 40 to form a one-way clutch. One end 41*a* of the wrap spring 41 is located within an opening 31*a* of the first extension member 32 to provide coupling between the actuation mechanism 18 and the advancing mechanism 19**.

Figure 5:
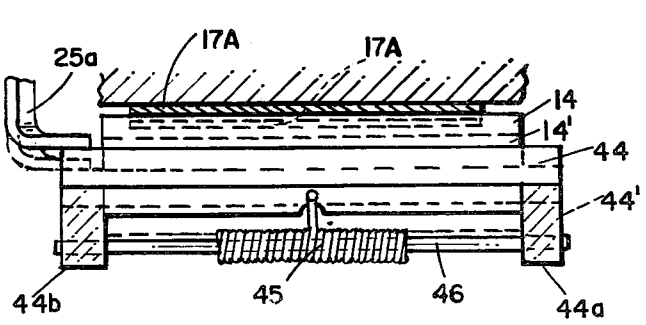
FIG. 5 is a side elevational view of the paper feeding mechanism taken along the lines 5—5 of FIG. 2.

Referring now also to FIGS. 4 and 5, a contact mechanism 20 is primarily comprised of the pressure pad 14, a support plate 44 and a spring 45. The pressure pad 14 may be of any suitable resilient material and may be affixed to the support plate 44 by suitable adhesive means. The support plate 44 includes a pair of arms **44*a* and 44*b* having suitable openings to allow the support plate 44 to be rotatably mounted to the inner walls 11*c*** and ll*d* by means of a rod 46. The spring 45, which is mounted on the rod 46, provides sufficient force to the support plate 44 to ensure contact between the paper 17A and the printing station 13 during the printing cycle.

Referring now to FIGS. 3–5, the operation of the paper feeding apparatus 11 during the paper advancement cycle will be described. Upon energization of the solenoid 21, the plunger 22 drives coupling member 23 and the elongated linkage member 24 to the position 23' and 24', respectively, as shown in dashed outline in FIG. 3. The vertically disposed linkage member 25, which is coupled to the first extension member 33 of the elongated linkage member 24, is rotated to the position 25' as shown in dashed outline in FIG.3. In turn, as shown in FIG. 5, the extended tab portion **25*a* is sufficiently urged against the arm 44*b* of the support plate 44 to overcome the force of the spring 45, whereby the support plate 44 and the pad 14 are moved downward, away from station 13 to new positions 44' and 14'. The paper 17A drops to the position designated 17A' to be free for advancement out of the paper feeding apparatus 11. At the same time, the wrap spring 41 rotates the cylindrical sleeve 40 in the counterclockwise direction as shown by the arrow designated D, as shown in FIG. 3. In turn, as shown in FIG. 4 the roller 15 is rotated in the counterclockwise direction, as shown by the arrow designated B, to advance the paper 17A in the direction of the arrow designated C. Upon de-energization of the solenoid 21, the plunger 22 retracts the coupling member 23 and the associated linkage members to the original starting position and the force of the spring 45 returns the pressure pad 14 to its normal position to place the next portion of the paper 17A in contact with the print station 13.**

Referring now to FIG. 6, there is shown a bottom plan view of the paper feeding apparatus 11, with portions cut away to expose various components located therein. On the bottom side 47 of the paper feeding apparatus 11, an access panel 48 is rotatably mounted thereto by means of a conventional hinge 49. The access panel 48 is maintained in the closed position by means of a latching bar 50 that is biased by a spring 51. The bottom side 47 of the paper feeding apparatus 11 includes two notches, **52*a* and 52*b*, as shown. The access panel 47 is opened by pushing the latching bar 50 so as to overcome the force of the spring 51 so that the ends 50*a* and 50*b* of the latching bar 50 are aligned with the notches 52*a* and 52*b*. The access panel 48 may then be rotated to the open position as shown in FIG. 7. As may be readily appreciated, a supply of fan folded paper 17A, e.g., in a cartridge 17, may be then placed on the inner side of the access panel 48 as shown, and the free end of the paper 17A readily placed over the roller 15 and the printing station. The access panel 48 may then be closed so as to properly position the paper 17A between the printing station 13 and the pressure pad 14.**

Thus, it may be appreciated that the above described paper feeding mechanism provides means for selectively advancing a supply of paper past a printing station of an electronic business machine. The paper feeding mechanism includes an access panel that may be opened to insert a new supply of fan folded paper.

Thus, although the present invention has been shown and described with reference to particular embodiments which are intended to be illustrative, not limitative, nevertheless, various changes and modifications obvious to a person skilled in the art to which the invention pertains, are deemed to lie within the spirit, scope and contemplation of the invention as set forth in the appended claims.

We claim:

1. Apparatus for selectively advancing paper past a printing station comprising:

a paper storing compartment having an access panel;

advance means mounted adjacent said paper storing compartment for advancing said paper past said printing station;

support means rotatably mounted on the frame of said apparatus for positioning a portion of said paper in contact with said printing station;

linkage means including controlled means coupled to said advance means and including means for engaging and moving said support means from said printing station, and for simultaneously moving said advance means to advance said portion of said paper a predetermined distance past said printing station, said advance means including a shaft having a roller fixedly mounted thereon, said roller being in contact with said paper; and one way clutch means mounted to one end of said shaft and coupled to said linkage means, said one way clutch means ensuring rotation of said shaft in only one direction.

2. Apparatus as recited in claim 1 wherein said storing compartment is adapted to store a supply of fan folded paper in a self-contained cartridge including an access panel permitting reloading of said fan folded paper.

3. Apparatus as recited in claim 2 wherein said first means includes access means for allowing a supply of fan folded paper to be inserted within said first means, said access means for supporting said supply of fan folded paper.

4. Apparatus as recited in claim 1 wherein said linkage means includes:

a first linkage member for engaging said support means to move said support means away from said printing station;

a second linkage member coupled to said storing compartment and said advance means, said second linkage member for moving a first direction within a defined path to impart motion to said first linkage member and said advance means, to move said support means away from said printing station in a downward direction and to move said advance means, respectively;

solenoid means coupled to said second linkage member for driving said second linkage member in said direction within said defined path; and said controlled means is located within said defined path for limiting the movement of said second linkage member in said first direction to control the distance said portion of said paper is moved past said printing station.

5. Apparatus as recited in claim 1 wherein said support means comprises:

a rotatably mounted member adapted to be engaged and rotated by said first linkage means, and biasing means for urging said rotatably mounted member towards said printing station to position said portion of said paper in contact with said printing station.

6. Apparatus as recited in claim 1 wherein said one-way clutch means comprises a cylindrical sleeve fixedly mounted on said one of said shaft and a wrap spring mounted on said cylindrical sleeve, one end of said wrap spring being coupled to said linkage means.

7. Apparatus as recited in claim 1 which further includes biasing means for urging said paper in contact with said roller.

8. Apparatus as recited in claim 1 wherein said means support means comprises:

a rotatably mounted member adapted to be engaged and rotated by said linkage means; and biasing means for urging said rotatably mounted member towards said printing station to position said portion of said paper in contact with said printing station.

9. Apparatus as recited in claim 8 wherein said support means further includes resilient means affixed to said rotatably mounted member for engaging said portion of said paper to insure contact of said portion of said paper with said printing station.

10. Apparatus as recited in claim 4 wherein said controlled means includes means for repositioning said controlled means within said defined path.

11. Apparatus as recited in claim 1 wherein said storing compartment comprises a self-contained cartridge for storing a fan-folded paper supply therein.

* * * * *